US005099766A

United States Patent [19]

Whitaker, Jr.

[11] Patent Number: 5,099,766

[45] Date of Patent: Mar. 31, 1992

[54] BALLAST WAGON FOR REVIEWING RAILWAY BALLAST WITH ROTARY STORAGE DRUMS

[75] Inventor: John B. Whitaker, Jr., Wetumpka, Ala.

[73] Assignee: Kershaw Manufacturing Company, Inc., Montgomery, Ala.

[21] Appl. No.: 567,633

[22] Filed: Aug. 15, 1990

[51] Int. Cl.[5] ..... E01B 27/06; E02F 5/22

[52] U.S. Cl. ..... 104/2; 105/239; 414/339; 414/502; 37/104

[58] Field of Search ..... 104/2, 5, 10, 12; 105/239, 248, 261.2; 414/339, 502; 198/599, 550.2, 637, 397, 612, 453; 37/104, 107

[56] References Cited

U.S. PATENT DOCUMENTS

| | | | |
|---|---|---|---|
| 1,551,080 | 8/1925 | Welcker | 105/239 |
| 1,778,690 | 10/1930 | Scheuchzer | 104/2 X |
| 1,980,895 | 11/1934 | Windecker | 105/239 X |
| 3,842,994 | 10/1974 | Theurer et al. | 414/339 |
| 4,456,419 | 6/1984 | Counts et al. | 198/637 X |
| 4,583,635 | 4/1986 | Timmer et al. | 198/443 X |
| 4,809,617 | 3/1989 | Theurer et al. | 104/2 X |
| 4,923,355 | 5/1990 | Mancini | 104/2 X |

*Primary Examiner*—Robert J. Oberleitner
*Assistant Examiner*—S. Joseph Morano
*Attorney, Agent, or Firm*—Jennings, Carter, Thompson & Veal

[57] ABSTRACT

A rotary dump wagon for handling ballast having a carriage with a first conveyor mounted thereon for conveying ballast the length of the carriage and a plurality of hollow drums supported by the carriage and engaging the first conveyor for rotational movement thereabout. Each drum has a plurality of elongated flights mounted to the inner surface thereof for lifting ballast to the first conveyor and at least one downwardly extendible plow blade suspended therein which selectively contacts the upper surface of the first conveyor thereby diverting ballast traveling thereon to the lower portion of the drum. A second conveyor is pivotally mounted to the carriage subjacent the discharge end of the first conveyor for horizontal movement about a vertical axis and extends upwardly and forwardly beyond the forward end of the carriage and above the first conveyor.

15 Claims, 5 Drawing Sheets

FIG. 3
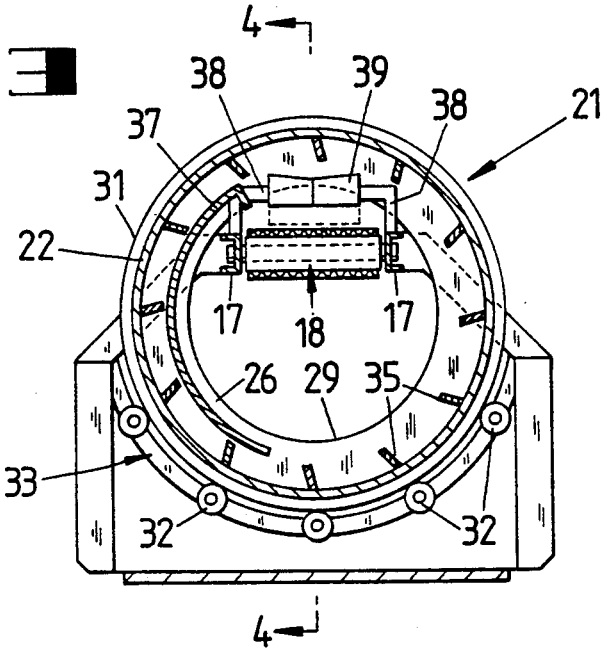
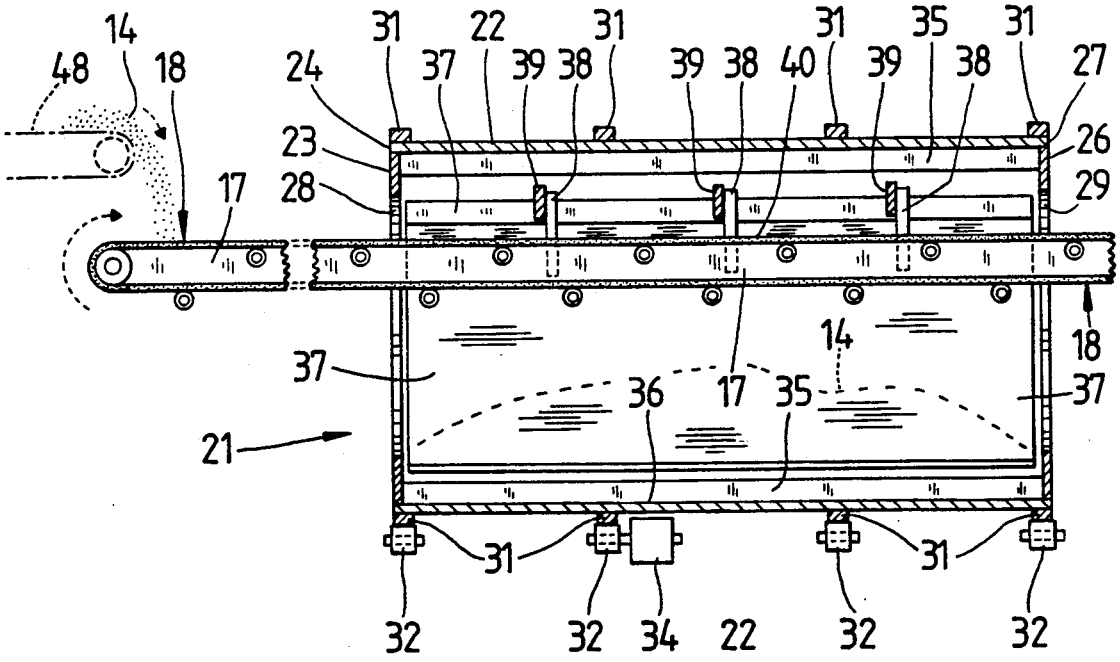
FIG. 4

BALLAST WAGON FOR REVIEWING RAILWAY BALLAST WITH ROTARY STORAGE DRUMS

FIELD OF THE INVENTION

The present invention relates to apparatus for repairing a ballast bed on which railroad track is supported. More particularly, the present invention relates to apparatus for handling railroad ballast. In greater particularity the present invention relates to mobile apparatus for receiving, storing and selectively discharging such ballast.

BACKGROUND OF THE INVENTION

The bed of a railroad track is typically constructed from a ballast rock such as gravel because the abrasive texture of such rocks holds a pile thereof in a substantially rigid formation. Over a period of time, the vibrations of overpassing trains wears the abrasive pores on the rock and fills these pores with particles of dust. As the ballast loses its abrasive surface, the bed loses its rigidity and the track supported thereon becomes immersed within the ballast. Consequently, old tallast must be periodically removed and replaced with new or refurbished ballast.

There currently exist track mounted devices for removing cleaning and sorting spoiled ballast, thereby producing a ballast suitable for reuse as a track bed. Examples of such tracked railbed reconditioners are disclosed in U.S. Pat. Nos., 4,563,826, 4,674,208, and 4,705,115 and U.S. Pat. No. 4,967,847 issued to Whitaker, Jr. For these and other such tracked railbed reconditioners to operate efficiently as a means for removing ballast, means for storing the removed ballast must be provided adjacent thereto during operation. The tracked railbed reconditioner disclosed in U.S. Pat. No. 4,967,847 also doubles as a means for redistributing large quantities of previously refurbished ballast and consequently, must be continually supplied with new ballast from a supply source traveling adjacently thereto. However, at present, a mobile unit which receives and stores ballast processed by such tracked railbed reconditioners and selectively discharges the stored ballast at a metered continuous pace does not exist.

The tracked railbed reconditioner disclosed in U.S. Pat. No. 4,967,847 can remove and replace a massive volume of ballast, consequently, a mobile means for storing and selectively supplying ballast to and from the tracked railbed reconditioner would have to comprise several railroad cars interconnected in train. At present there exist no apparatus for conveying ballast across a plurality of interconnected cars nor means for discharging the abrasive ballast rock from a mobile storage car prior to such conveyance. Because of the weight and abrasive texture of the ballast rock, the unloading thereof from a confined storage area is very difficult.

SUMMARY OF THE INVENTION

It is the principal object of the present invention to provide a railroad car for receiving and storing quantities of railroad ballast.

In support of the principal object, another object of the present invention is to provide a railroad car that can selectively discharge ballast stored therein in a continuous regulated stream.

Yet another object of the invention is to provide a railroad car that operates in cooperation with similar railroad cars interconnected in train to convey a quantity of ballast to selected points along such train.

These and other objects and advantages of my invention are accomplished through the use of a mobile carriage having a receiving chute mounted at a rearward end thereof, a conveying means, including a first conveyor which extends the length of the carriage to a point proximate the forward end of the carriage and a second conveyor which extends from a point subjacent the discharge end of the first conveyor to a point above the chute and forward of the forward end of the carriage. A plurality of drums are pivotally mounted to the carriage for rotational movement about the first conveyor for receiving and storing a quantity of ballast therein. Upon rotation, the drums deliver such ballast to the conveyor using a plurality of flights connected to the interior of such drums. At least one extendible plow blade is mounted within each drum and when extended contacts the upper surface of the driven first conveyor belt to divert ballast traveling thereon from the conveyor belt to the lower portion of the drum.

BRIEF DESCRIPTION OF THE DRAWINGS

Apparatus embodying features of my invention are depicted in the accompanying drawings which form a portion of this disclosure and wherein:

FIG. 3: is a sectional view taken along line 3—3 of FIG. 1;

FIG. 4: is a sectional view taken along line 4—4 of FIG. 3;

DESCRIPTION OF A PREFERRED EMBODIMENT

Figure 1:
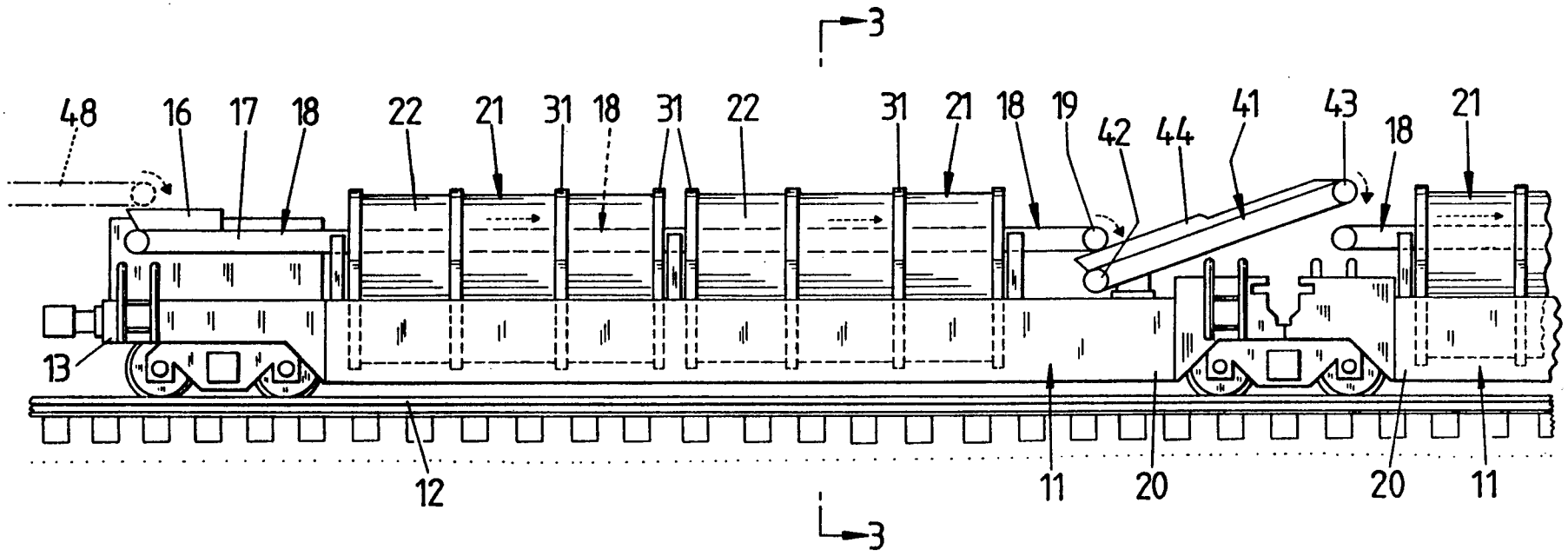
FIG. 1: is a side elevational view of my rotary ballast wagon supported by a railroad track.
Figure 2:
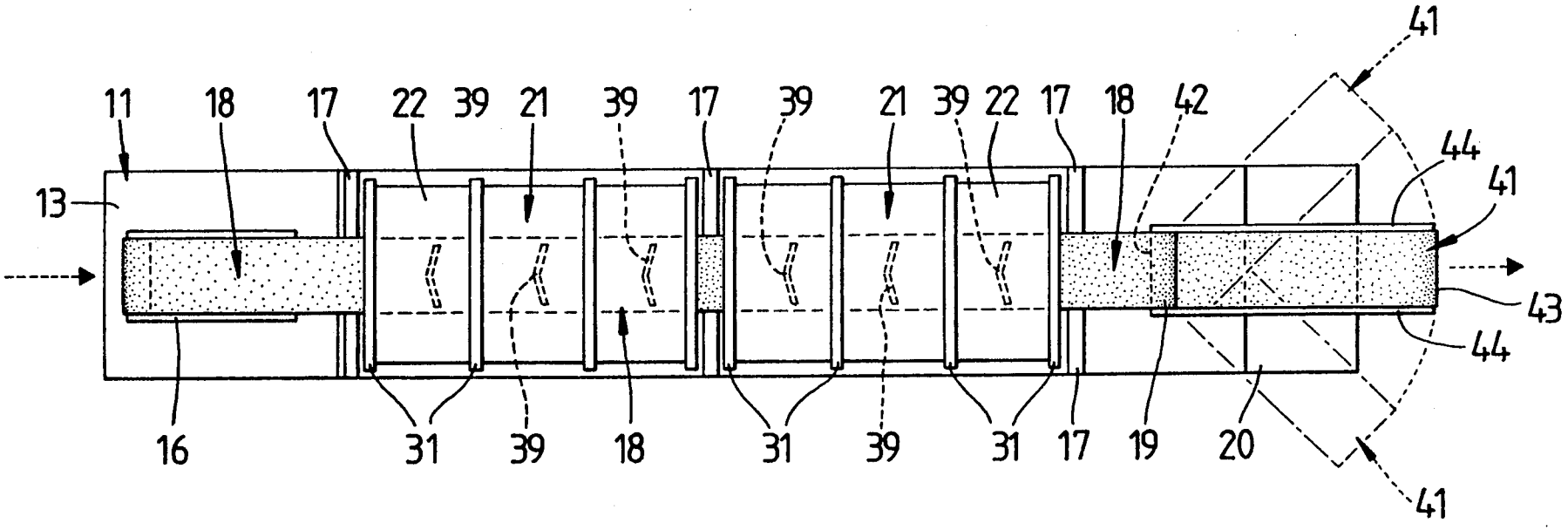
FIG. 2: is a top plan view of the rotary ballast wagon.

Referring to the drawings for a clearer understanding of the invention, it should be noted in FIG. 1 that the preferred embodiment of the present invention contemplates the use of a carriage 11 adapted for travel on a set of railroad rails 12. Mounted to the rearward end 13 of the carriage 11 is a means for receiving ballast 14 which includes a chute 16. As shown in FIGS. 1 and 2, a means for conveying the ballast 14 the length of the carriage 11 includes a frame 17 connected to the carriage 11 and a first conveyor 18 mounted to the frame 17 in spaced relation above the carriage. The first conveyor 18 extends from a point rearward of and below the chute 16 to a forward point 19 proximate the forward end 20 of the carriage 11.

As shown in FIGS. 1–4, a means for storing the ballast 14 includes a plurality of drums 21 mounted to the carriage 11 for rotational movement about a common horizontal axis in parallel axial relation to the longitudinal axis of the carriage 11, wherein said first conveyor 18 extends through the drums 21 in parallel relation to the horizontal axis thereof. Each drum 21 includes a cylindrical casing 22 having a hollow interior, a forward wall 23 concentrically mounted to a forward margin 24 of the casing 22 in normal extension toward the longitudinal axis thereof and a rearward wall 26 concentrically mounted to a rearward margin 27 of the casing 24, in spaced relation to the forward wall 23, wherein the forward wall 23 defines a concentric forward aperture 28 and the rearward wall 26 defines a concentric rearward aperture 29 through which the first conveyor 18 extends. A plurality of circular tracks 31, shown in FIGS. 1–3, circumscribe the outer surface of casing 22 in longitudinally spaced relation thereon.

Means for rotating the drums 21 in a predetermined direction include a plurality of rollers 32, each pivotally mounted to the carriage 11 for rotational movement about a horizontal axis. As shown in FIGS. 3 and 4, the rollers 32 are mounted to the carriage 11 in a plurality of upwardly arcuate formations 33 which share a common axis parallel the longitudinal axis of the carriage 11 wherein each formation 33 of rollers 32 supports one of the plurality of tracks 31. As seen in FIG. 4, a means for driving the rollers 32 in rotational movement about their horizontal axis is connected to the carriage 11 and includes a motor 34 operatively connected to selected rollers 32, wherein the motor 34 can be remotely operated to rotate each drum 21 individually or in unison with selected others of the plurality of drums 21.

Figure 6:
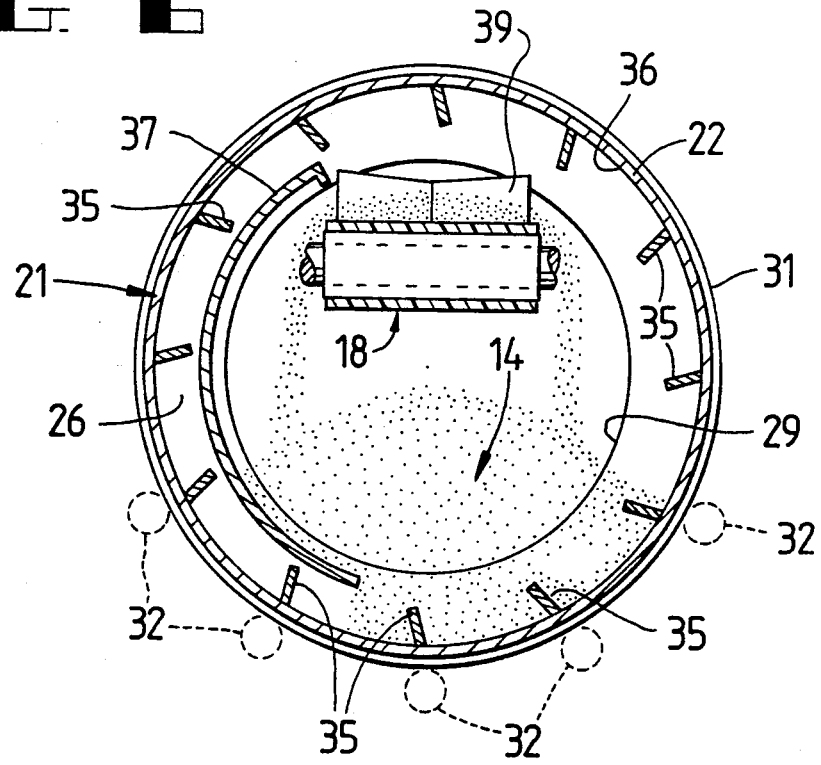
FIG. 6: is a sectional view corresponding to FIG. 3 showing the rotary ballast wagon during the loading procedure.
Figure 7:
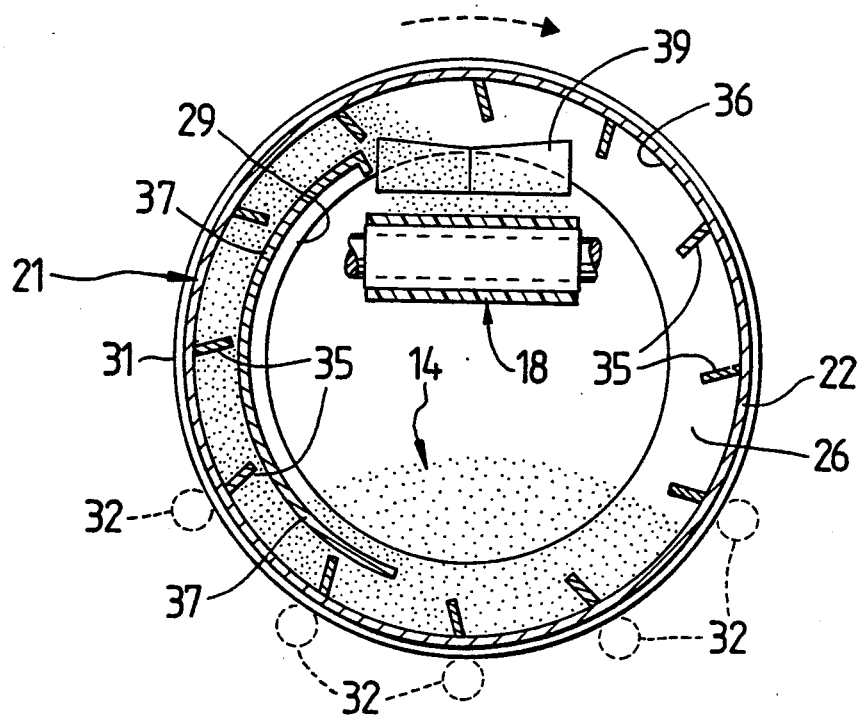
FIG. 7: is a sectional view corresponding to FIG. 3 showing the rotary ballast wagon during the unloading procedure.

As shown in FIGS. 3, 6, and 7, each drum 21 includes a plurality of elongated flights 35 connected to the inner surface 36 of the casing 22 in spaced relation thereon. Each flight 3 extends from the inner surface 36 toward the axis of the drum 21 being offset from perfect radial extension therefrom a predetermined angular distance toward a predetermined direction the drum 21 is rotated. An arcuate ballast plate 37 is fixed to the frame 17 and extends the length of the drum 21 in spaced relation thereto. The ballast plate 37 extends proximal the innermost extention of the flights 35 to a point above the first conveyor 18.

As shown in FIGS. 2–4 and 6–7, means for selectively diverting ballast from the first conveyor belt 18 into a selected one of the plurality of drums 21 includes a plurality of support members 38 each mounted to the first frame 17 within one of the drums 21 and extending vertically from the frame 17 over the first conveyor 18. At least one extendible plow blade 39 is mounted to each support member 38 for selected downward extension therefrom. When fully extended, each plow blade 39 is proximal the upper surface 40 of the first conveyor 18 whereby ballast conveyed thereon is diverted by the plow blade 39 from the first conveyor 18 to the lower portion of the casing 22. Each plow blade 39 is individually operated to facilitate the loading of selected drums 21.

A second conveyor 41 is pivotally mounted to the carriage 11 for horizontal movement about a vertical axis. The second conveyor 41 extends from a lowermost point 42 subjacent the forward point 19 of the first conveyor 18 to an uppermost point 43 forward of the forward end 20 of the carriage 11 and above the chute 16. The lowermost point 42 remains subjacent said forward point 19 whereas the uppermost point 43 pivots in an arc distal the forward and lateral edges of the carriage 11. The second conveyor 41 can be secured within a vertical plane including the longitudinal axis of the carriage 11. A skirt 44 is mounted to the second conveyor 41 to prevent ballast from falling from the lateral and lower margins thereof.

Figure 5:
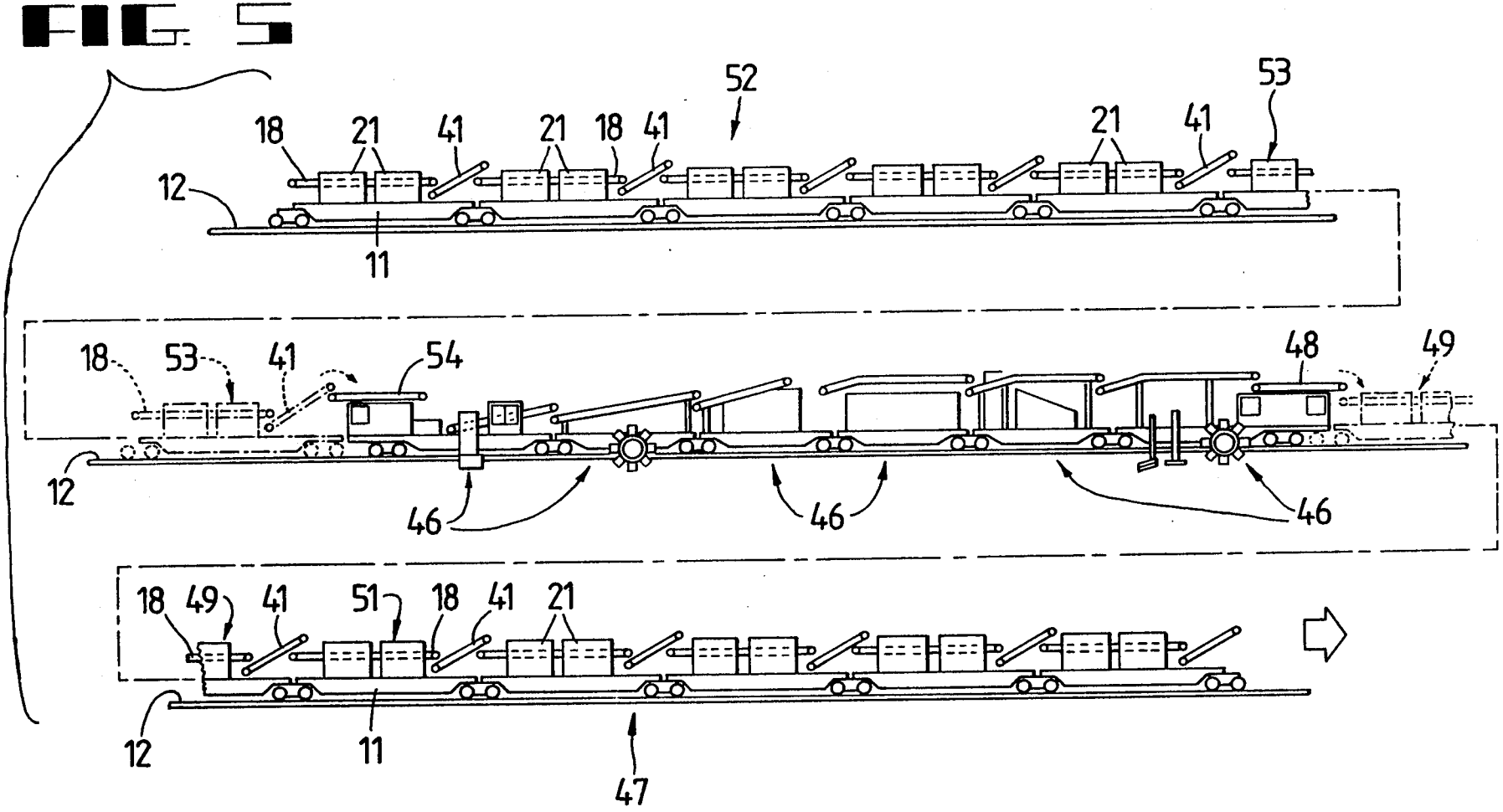
FIG. 5: is a side elevational view of a selected arrangement of rotary ballast wagons connected to a railroad ballast cleaning apparatus.

As shown in FIG. 5, the present invention is connected in train with other railroad cars of like construction and a tracked railbed reconditioner 46. A first string of cars 47 is connected forward of the tracked railbed reconditioner 46 for receiving ballast 14 removed from beneath the rails 12 by the tracked railbed reconditioner 46. A discharge conveyor 48 mounted on the forward portion of the tracked railbed reconditioner 46 extends to a point over the chute 16 of an adjacent first forward car 49. Ballast 14 conveyed by the discharge conveyor 48 eventually falls into the chute 16 and consequently lands and is carried forward on the first conveyor 18. If so selected, one or more of the plurality of plow blades 39 mounted in the first forward car 49 may be extended thereby diverting the ballast into the selected drum 21. The drums 21 remain stationary during loading and storage periods and, as discussed below, rotate only during unloading periods. If so selected, no plow blades 39 need be extended on the first forward car 49, thereby permitting the first conveyor 18 to convey and dump the ballast onto the second conveyor 41. The second conveyor 41 of the first forward car 49 extends to a point over the chute 16 of a second forward car 51 connected forwardly adjacent of the first forward car 49 and conveys and dumps the ballast conveyed thereon into the chute 16. This conveyance procedure can be perpetually repeated until the ballast is received by the forwardmost car 49 of the first string of cars 47 whereupon one of the plow blades 39 connected to the forwardmost car 49 will be extended to load a selected drum 21.

As shown in FIG. 5, a second string of cars 52 is mounted to and rearward of the tracked railbed reconditioner 46 and carries a load of new or refurbished ballast. The second conveyor 41 of an adjacent first rearward car 53 extends upward and over a fresh ballast conveyor 54 mounted on the rearward portion of the tracked railbed reconditioner 46. Other cars of the second string of cars 52 are connected to the first rearward car 53 in like configuration to that previously described relative to the first string of cars 47.

To unload the second string of cars 52 and convey the ballast 14 stored therein to the tracked railbed reconditioner 46, one or more selected drums 21 are rotated concurrently with the activation of the first and second conveyors. As shown in FIG. 7, a drum 21, when rotated, carries ballast 14 on the flights 35 in an upward direction. The predetermined angular offset of the flights 35 from perfect radial extension facilitate the lifting of the ballast 14 above the first conveyor 18, whereupon reaching a predetermined point, the ballast 14 is gravitationally dumped from the flights 35 onto the first conveyor 18. The arcuate plate 37 prevents the ballast 14 from falling from the flights 35 before reaching the predetermined point above the first conveyor 18. The first and second conveyors convey the ballast 14 as previously described until the ballast reaches the tracked railbed reconditioner 49. Ballast from two or more cars can be unloaded and conveyed simultaneously with the rotation of the drums 21 and the speed the conveyors being regulated to control the flow of ballast to the tracked railbed reconditioner 49. As shown in FIG. 2, the second conveyors 41 can be pivoted to discharge the ballast 14 alongside the rails 12. From the foregoing, it should be clear that the present invention represents a substantial improvement over the prior art.

While I have shown my invention in one form, it will be obvious to those skilled in the art that it is not so limited but is susceptible of various changes and modifications without departing from the spirit thereof.

What I claim is:

1. A rotary dump wagon handling railroad ballast comprising, in combination:

(a) a carriage;

(b) a first conveyor mounted at a predetermined height on said carriage for conveying said ballast over a predetermined length of said carriage; and (c) storing means supported by said carriage for selective rotational movement about a horizontal axis and about said first conveyor for storing said ballast delivered thereto by said first conveyor, wherein said first conveyor both conveys said ballast to said storage means and receives said ballast therefrom for disbursement, said storing means including a plurality of elongated flights mounted to said storing means and extending parallel to said horizontal axis such that rotation of said storing means causes said flights to lift said ballast stored therein onto said first conveyor for discharge of said ballast thereby.

2. A rotary dump wagon as described in claim 1 comprising a chute mounted to a rearward end of said carriage for receiving said ballast.

3. A rotary dump wagon as described in claim 2 further comprising a frame affixed to said carriage and to said first conveyor for supporting said first conveyor in spaced relation above said carriage, wherein said first conveyor extends from a point rearward of said chute to a forward point proximate a forward end of said carriage.

4. A rotary dump wagon as described in claim 3 wherein said storing means comprises a plurality of drums supported by said carriage for rotational movement about said horizontal axis in parallel axial relation to a longitudinal axis of said carriage, wherein said first conveyor extends through said drums in parallel relation to said horizontal axis thereof.

5. A rotary dump wagon as described in claim 4 comprising a means connected to said carriage for rotating said drums.

6. A rotary dump wagon as described in claim 4 comprising a plurality of arcuate plates each fixed to said frame and coextending one of said plurality of drums in spaced relation thereto and proximal the innermost extention of said flights from said drum.

7. A rotary dump wagon as described in claim 4 comprising an urging means connected to said frame for selectively urging said ballast from said first conveyor into a selected one of said drums.

8. A rotary dump wagon as described in claim 7 wherein said urging means comprises:

(a) a plurality of beam members, each mounted to said frame within one of said plurality of drums and extending upwardly from said frame over said first conveyor belt; and (b) a plurality of plow blades, each mounted to one of said beam members for selected downward extension therefrom, wherein said plow blades, when fully extended, are proximal the upper surface of said first conveyor.

9. A rotary dump wagon as described in claim 3 further comprising a second conveyor mounted to said carriage and extending from a lowermost point subjacent said first conveyor to an uppermost point positioned forwardly of said forward end of said carriage and above said chute, wherein the longitudinal axis of said second conveyor extends within a vertical plane including the longitudinal axis of said first conveyor.

10. A rotary dump wagon as described in claim 3 further comprising a second conveyor pivotally mounted to said carriage for horizontal movement about a vertical axis, wherein said second conveyor extends from a lowermost point subjacent said first conveyor to an uppermost point above said chute, wherein said lowermost point remains subjacent said first conveyor and said uppermost point pivots in an arc distal the forward and lateral edges of said carriage.

11. A rotary dump wagon handling railroad ballast, comprising:

(a) a carriage;

(b) a chute mounted to a rearward end of said carriage for receiving said ballast;

(c) conveying means supported by said carriage for conveying said ballast over a predetermined length of said carriage and having a frame affixed to said carriage and a first conveyor mounted to said frame in spaced relation above said carriage, wherein said conveyor extends from a point rearward of said chute to a forward point proximate a forward end of said carriage;

(d) storing means supported by said carriage for rotational movement about a horizontal axis and about said conveying means for storing said ballast delivered thereto by said conveying means and comprising a plurality of drums supported by said carriage for rotational movement about said horizontal axis in parallel relation to a longitudinal axis of said carriage, wherein said first conveyor extends through said drums in parallel relation to said horizontal axis thereof; said drum including a cylindrical casing having a hollow interior, a forward wall concentrically mounted to a forward margin of said casing and defining a concentric forward aperture through which said first conveyor extends, and a rearward wall mounted to a rearward margin of said casing, in spaced relation to said forward wall and defining a concentric rearward aperture through which said first conveyor extends.

12. A rotary dump wagon as described in claim 11 wherein said drum comprises a plurality of circular tracks circumscribing the outer surface of said casing in spaced relation thereon.

13. A rotary dump wagon as described in claim 12 comprising a rotating means connected to said carriage for rotating said drums in a predetermined direction.

14. A rotary dump wagon as described in claim 13 wherein said rotating means comprises:

(a) a plurality of rollers pivotally mounted to said carriage for rotational movement about a second horizontal axis, wherein said rollers support said tracks in tangential abutment therewith; and (b) a means mounted to said carriage and selected ones of said plurality of rollers for driving said selected rollers, wherein said selected rollers when so driven rotate said drum.

15. A rotary dump wagon handling railroad ballast, comprising:

(a) a carriage;

(b) a chute mounted to a rearward end of said carriage for receiving said ballast;

(c) conveying means supported by said carriage for conveying said ballast over a predetermined length of said carriage and having a frame affixed to said carriage and a first conveyor mounted to said frame in spaced relation above said carriage, wherein said conveyor extends from a point rearward of said chute to a forward point proximate a forward end of said carriage;

(d) storing means supported by said carriage for rotational movement about a horizontal axis for storing said ballast delivered thereto by said conveying means and having a plurality of drums supported by said carriage for rotational movement about said horizontal axis in parallel relation to a longitudinal axis of said carriage, wherein said first conveyor extends through said drums in parallel relation to said horizontal axis thereof; said drums including a cylindrical casing having a hollow interior, a forward wall concentrically mounted to a forward margin of said casing and defining a concentric forward aperture through which said first conveyor extends, a rearward wall mounted to a rearward margin of said casing, in spaced relation to said forward wall and defining a concentric rearward aperture through which said first conveyor extends, and a plurality of elongated flights connected to an inner surface of said casing in spaced relation thereon and in parallel relation to the longitudinal axis thereof, wherein each flight laterally extends from said inner surface offset from a perfect radial extension therefrom a predetermined angular distance toward a predetermined angular direction when said drum is rotated.

* * * * *